US007154394B2

(12) United States Patent
Zhou

(10) Patent No.: US 7,154,394 B2
(45) Date of Patent: Dec. 26, 2006

(54) HIDDEN SECURITY DEVICE AND CONTAINER USING THE SAME

(75) Inventor: Yuanda Zhou, Guangdong (CN)

(73) Assignee: China International Marine Containers (Group) Co., Ltd., Guangdong (CN)

( * ) Notice: Subject to any disclaimer, the term of this patent is extended or adjusted under 35 U.S.C. 154(b) by 72 days.

(21) Appl. No.: 10/973,318

(22) Filed: Oct. 26, 2004

(65) Prior Publication Data

US 2005/0087995 A1 Apr. 28, 2005

(30) Foreign Application Priority Data

Oct. 27, 2003 (CN) ..... 2003 2 01021515

(51) Int. Cl.
*G08B 13/14* (2006.01)

(52) U.S. Cl. ..... 340/568.8; 340/545.1; 340/546; 340/545.5; 340/545.9; 49/7; 49/9; 116/12; 220/1.5; 220/315; 220/324

(58) Field of Classification Search ..... 340/568.8, 340/545.1, 545.5, 545.6, 545.9; 292/295, 292/292, 266, 288; 116/12; 49/7, 9; 220/315, 220/324, 1.5

See application file for complete search history.

(56) References Cited

U.S. PATENT DOCUMENTS 6,878,643 B1 * 4/2005 Krulevitch et al. ..... 438/780
2004/0119588 A1 * 6/2004 Marks ..... 340/539.1

* cited by examiner

*Primary Examiner*—Jeffery Hofsass
*Assistant Examiner*—Edny Labbees
(74) *Attorney, Agent, or Firm*—Greer, Burns & Crain, Ltd.

(57) ABSTRACT

A hidden security device for a container of cargo transportation includes a case provided with an electronic processing unit; a tightly-seized device, including a plate, extending from the case, on which a displacement sensor communicating with the electronic processing unit is provided at a predetermined place; and a tightly-seized part, perpendicularly extending from the plate and having a flexing end; and an antenna, communicating with the electronic processing unit and extending out from the case to the flexing end of the tightly-seized part. The present security device can accurately record the time and frequency of opening the door plates of the container, and meanwhile it is disposed on the inner side of the door plates, and is readily concealed.

17 Claims, 8 Drawing Sheets

HIDDEN SECURITY DEVICE AND CONTAINER USING THE SAME

FIELD OF THE INVENTION

The present invention relates to a security device for cargo containers, particularly, to a hidden security device fixed on the inner side of the door plates of such containers.

BACKGROUND OF THE INVENTION

As the development and enlargement of the international trade continues, container transportation has become an important facet of cargo transportation. It has been widely adopted by all countries over the world because it has advantages such as large transport capacity, low transport cost etc. However, in the near future, as all the countries in the world improve their security consciousness of keeping away risk and terrorism, they demand safer and safer container transportation. One of the more important demands is the specific safeguard for the cargo transportation containers entering their country, which can ensure the containers are maintained secure by being encapsulated at the point of departure, i.e. premature or unlawful opening of the containers is not permitted. However, it is difficult to properly find out, control and avoid the unlawful opening of containers during their transportation and storage. Previously, visual examination of the container opening, connecting, and locking etc. assembly, was required to determine whether the container is unlawfully opened. The above examination is both difficult and labor intensive, with the possibility of failure.

While the security measures for containers of prior art are mostly improvements on the aspect of mechanical structures, they cannot monitor the containers and are very inconvenient. For instance, when the container is opened unlawfully, the mechanical structures cannot give an alarm or record information etc., and therefore they cannot avoid theft in good time.

SUMMARY OF THE INVENTION

It is an object of the present invention to provide a hidden security device for containers, which can accurately detect and record information by providing a displacement sensor and an electronic processing unit within the container. It is another object of the present invention to provide a container with enhanced security, which is equipped with a hidden security device on the inner side of the door plates and can monitor the opening of the door plates with a displacement sensor.

To achieve the above-mentioned objects, the present invention provides a hidden security device for containers, comprising a case with an electronic processing unit; a tightly-seized device, which comprises a plate, extending from the case, on which a displacement sensor communicating with the electronic processing unit is inserted at a predetermined place; and a tightly-seized part, perpendicularly extending from the plate and having a flexing end; and an antenna, communicating with the electronic processing unit and extending out from the case to the flexing end of the tightly-seized part. The antenna is a thin elastic chip or is covered with an elastic chip and the tightly-seized device is of an elastic material. The security device can also comprise a fixing device. The fixing device can be a magnet placed in the case or it can be a couple of wing plates extending from the plate, which are fixed by bolts (or rivets). Preferably, the security device also includes an anti-cheating blocker placed on the outer side of the tightly-seized part.

To achieve the above-mentioned object , the present invention preferably further provides a container with a door structure of two door plates, comprising a hidden security device on the inner side of the door plates of the container. The device has a case corresponding to the first door plate and an electronic processing unit therein; a tightly-seized device, comprising a plate which extends from the case and a displacement sensor communicating with the electronic processing unit at a predetermined place thereon corresponding to the second door plate; a tightly-seized part perpendicularly extending out from the plate through a distance between the two door plates having a flexing end; and an antenna, communicating with the electronic processing unit and extending out from the case to the flexing end of the tightly-seized part. The tightly-seized part cooperates with a vertical doorpost of the first door plate to fix the security device, while the flexing end is disposed on the outer side of the door plates. The antenna is a thin elastic chip or is covered with an elastic chip. The tightly-seized device is made of an elastic material. Specially, the security device can comprise a fixing device. The fixing device can be a magnet placed in the case or it can comprise a couple of wing plates extending from the plate, which are fixed by bolts (or rivets). The container further comprises a vibration detector placed in the case, which is used to sense vibrations at predetermined frequency and communicate them with the electronic processing unit. Specially, the container further comprises an anti-cheating blocker placed on the outer side of the tightly-seized part, corresponding to the distance between the first and second door plates.

One aspect of the present invention is that the security device is disposed on the inner side of the door plates of the container keeping it hidden so it cannot be easily destroyed. Meanwhile, the hidden security device of the present invention can be fixed on the inner side of the door plates of the container by using the tightly-seized device and can then be easily fixed. Therefore, the hidden security device of the present invention can be conveniently used to improve the existing containers.

To sense the movement of the door plates by the displacement sensor disposed on the door plates of container, the hidden security device of the present invention can accurately record the time and frequency of when the container door plates open.

Furthermore, because the hidden security device of the present invention is equipped with a vibration detector, it can sense vibrations at a predetermined frequency, such as the vibrations produced by an electric drill. Another distinct feature of the present invention is the accurate recording of when electric drills etc. breach the container.

BRIEF DESCRIPTION OF THE DRAWINGS

These and other objects of the invention will be apparent from the following detailed descriptions of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Figure 1:
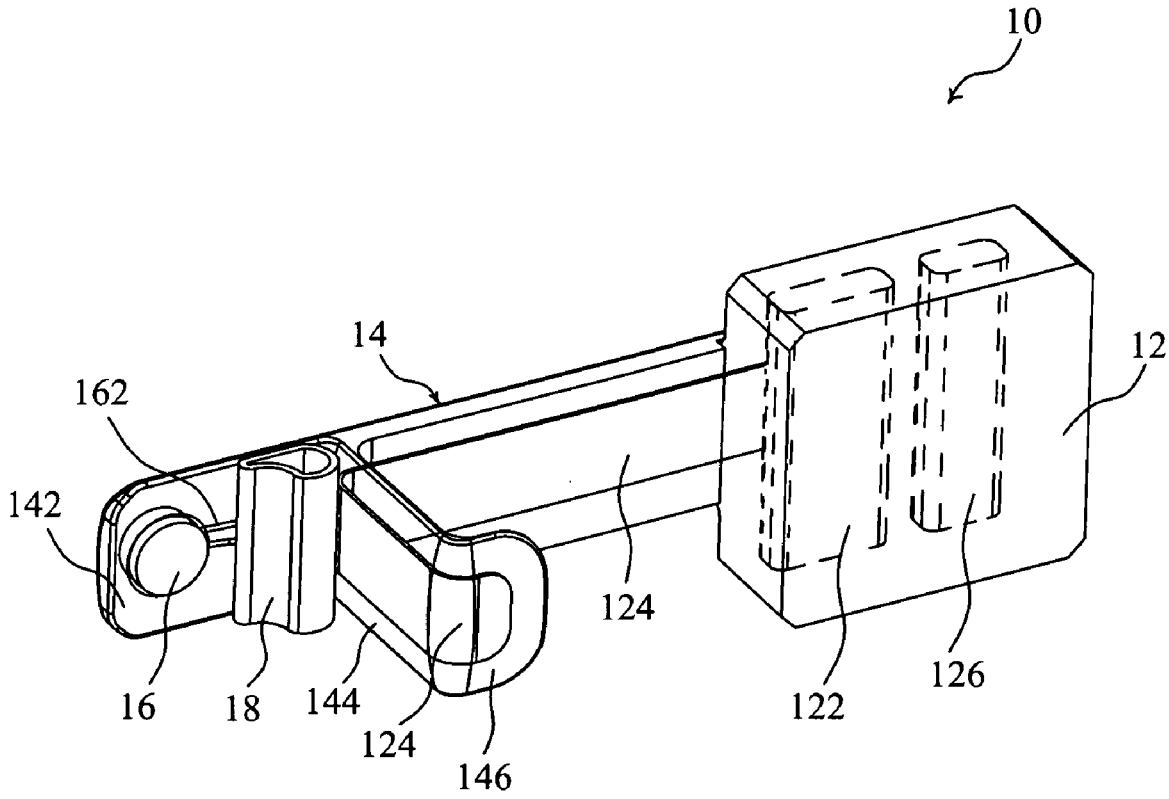
FIG. 1 is a perspective view illustrating a hidden security device according to an embodiment of the present invention.

FIG. 1 illustrates a hidden security device 10 for cargo containers, comprising a case 12 and a tightly-seized device 14 which extends from the case 12 and comprises a plate 142 and a tightly-seized part 144 perpendicularly extending from the plate 142. Preferably, the tightly-seized part 144 has a flexing end 146. In the present invention, an electronic processing unit 122 for giving an alarm and recording information is provided in the case 12; meanwhile, a displacement sensor 16 communicating with the electronic processing unit 122 via a lead 162 is provided on the plate 142 of the tightly-seized device 14. For the electronic processing unit 122 of the present invention to communicate externally of the container more efficiently, the hidden security device 10 of the invention is further provided with an antenna 124. The antenna 124 connected to the electronic processing unit 122 is a thin elastic chip or is covered with an elastic chip, which extends out from the case 12 and along the tightly-seized device 14 to the flexing end 146 of the tightly-seized part 144. The exterior surfaces of both the antenna 124 and the tightly-seized part 144 can be covered by insulating layers.

Preferably, the hidden security device 10 of the present invention further comprises a vibration detector 126, which communicates with the electronic processing unit 122 and is placed in the case 12. When the malefactor commits an offence to the container, for example, by using an electric drill etc., a vibration at a predetermined frequency is produced. If the vibration continues for a certain amount of time, the vibration detector 126 will acknowledge the signals with the features stated above and will send a signal to the electronic processing unit 122. In this way, the electronic processing unit 122 can create a warning and record the information of when an offence is committed to the container.

Furthermore, the hidden security device 10 of the present invention can comprise an anti-cheating blocker 18, which is placed on the outer side of the tightly-seized part 144 with the bottom on the plate 142.

Figure 2:
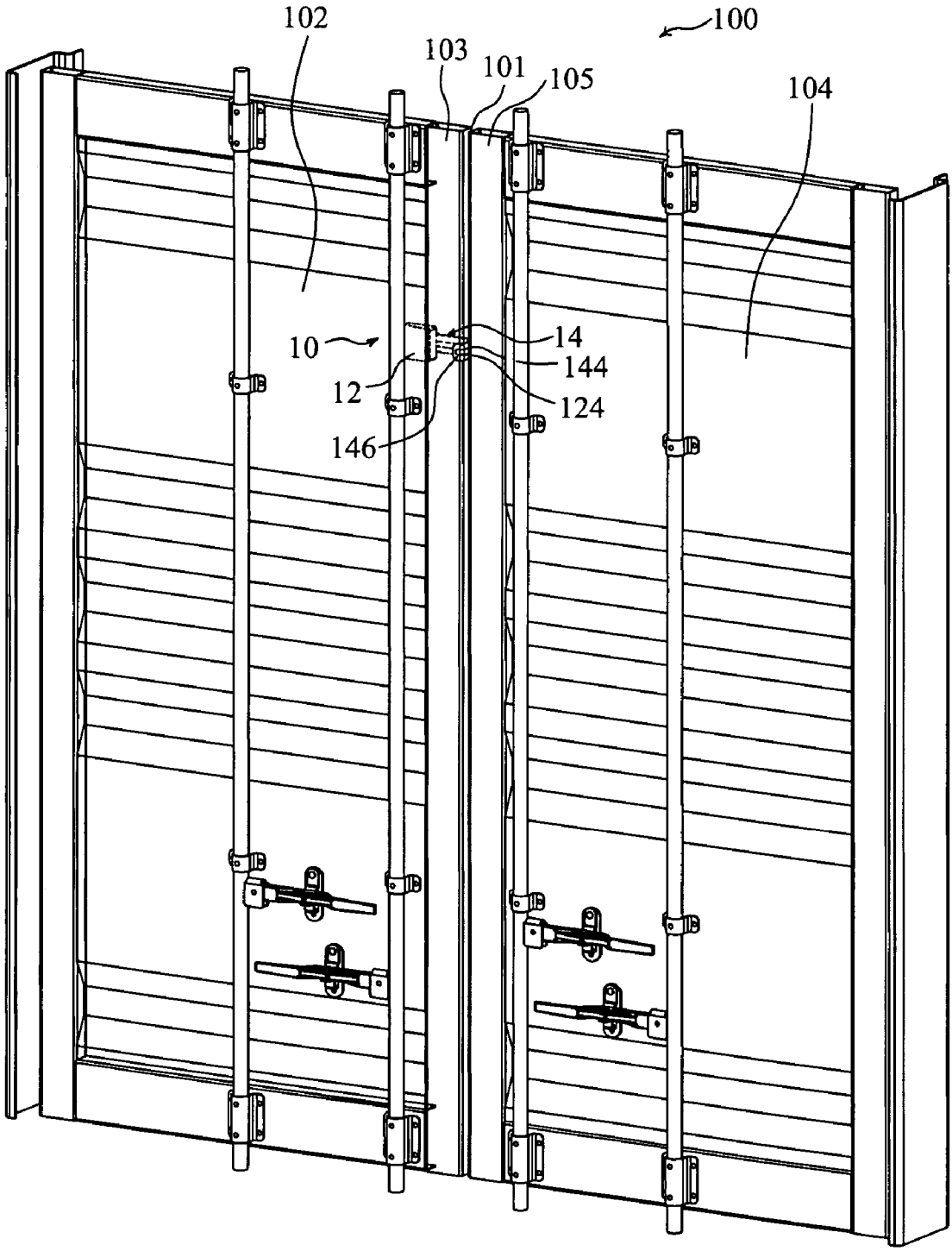
FIG. 2 is a schematic view illustrating the door structure with a hidden security device according to an embodiment of the present invention.

The hidden security device 10 of the present invention cooperates with the door plates of the container. Referring to FIG. 2, a schematic view illustrating the door structure 100 of the container, the door structure 100 comprises a left door plate 102 and a right door plate 104. When the left and right door plates (102, 104), which are actually opened outwards, are closed, a distance 101 will exist between their respective vertical doorposts 103/105. In the preferred embodiments of the invention, the hidden security device 10 is fixed on the inner side of the left door plate 102 of the container; the tightly-seized device 14, together with the antenna 124, extends out from the distance 101; and then the hidden security device 10 is fixed by a seizing action of the flexing end 146. Accordingly, the antenna 124 is ensured to be able to communicate with the outside world by signaling around the door plates. The blocker 18 (as shown in FIG. 1) of the security device 10 corresponds to the distance 101 between the two vertical doorposts 103/105 so as to prevent the malefactors from destroying or cutting the communication between the sensor, the antenna and the electronic processing unit.

Figure 3:
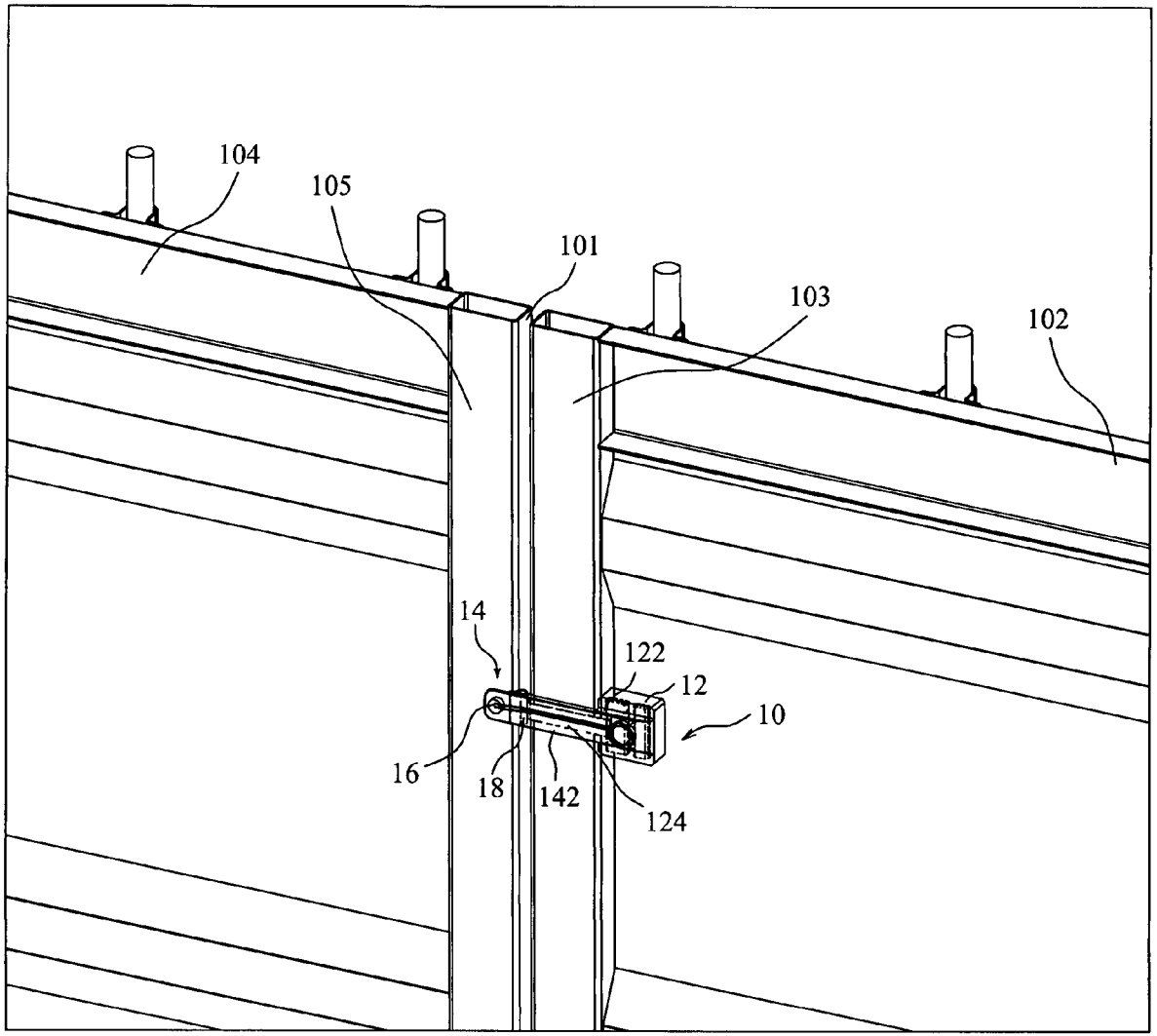
FIG. 3 is a schematic view illustrating the inner side of the door structure of FIG. 2.

FIG. 3 illustrates a schematic view of the inner side of the door structure 100 with a hidden security device 10 of the present invention. The plate 142 of the tightly-seized device 14 has a displacement sensor 16 corresponding to the vertical doorpost 105 of the right door plate 104. Accordingly, when the door plate of the container is opened, the displacement sensor 16 will transmit signals to the electronic processing unit 122.

Figure 4A:
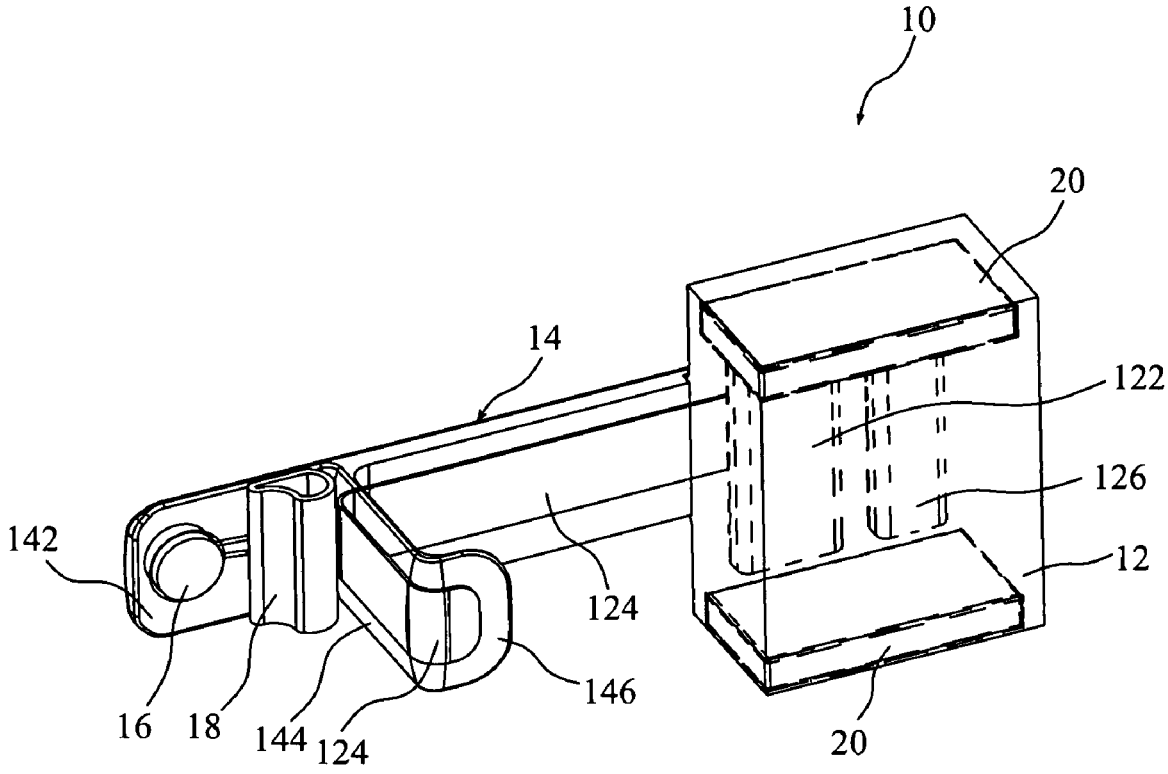
FIG. 4A is a schematic view illustrating a hidden security device with a magnet in a case thereof according to a second embodiment of the present invention.
Figure 4B:
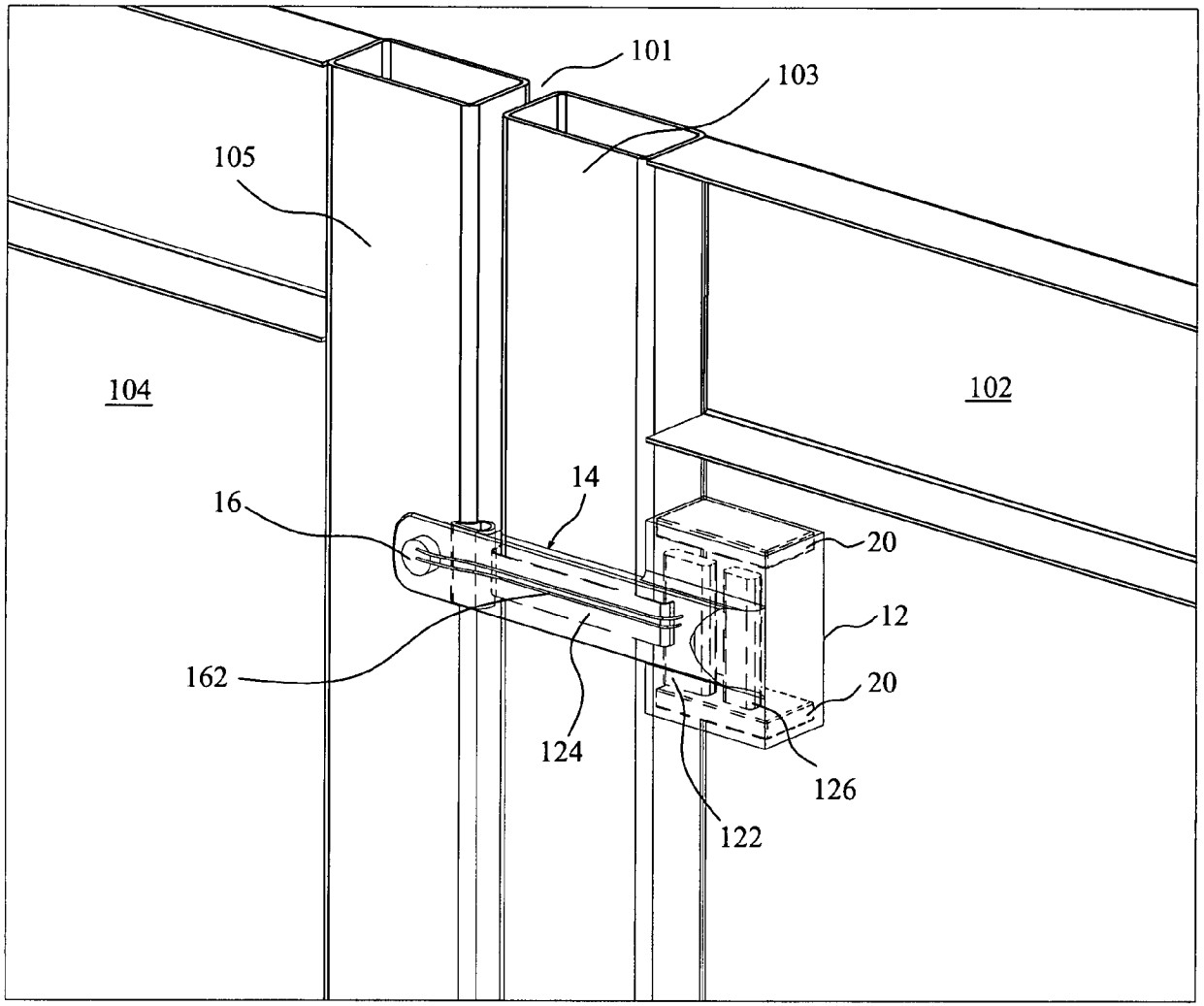
FIG. 4B is a schematic view illustrating the hidden security device of FIG. 4A cooperating with the door plates.

Considering the reliability for long-term use of the security device 10, the present invention also provides a fixing device. As shown in FIG. 4A, one method of fixing is to make use of a magnet 20 placed in the case 12, which can be attracted to the door plate 102. The attraction enhances the reliability of the security device, as shown in FIG. 4B.

Figure 5A:
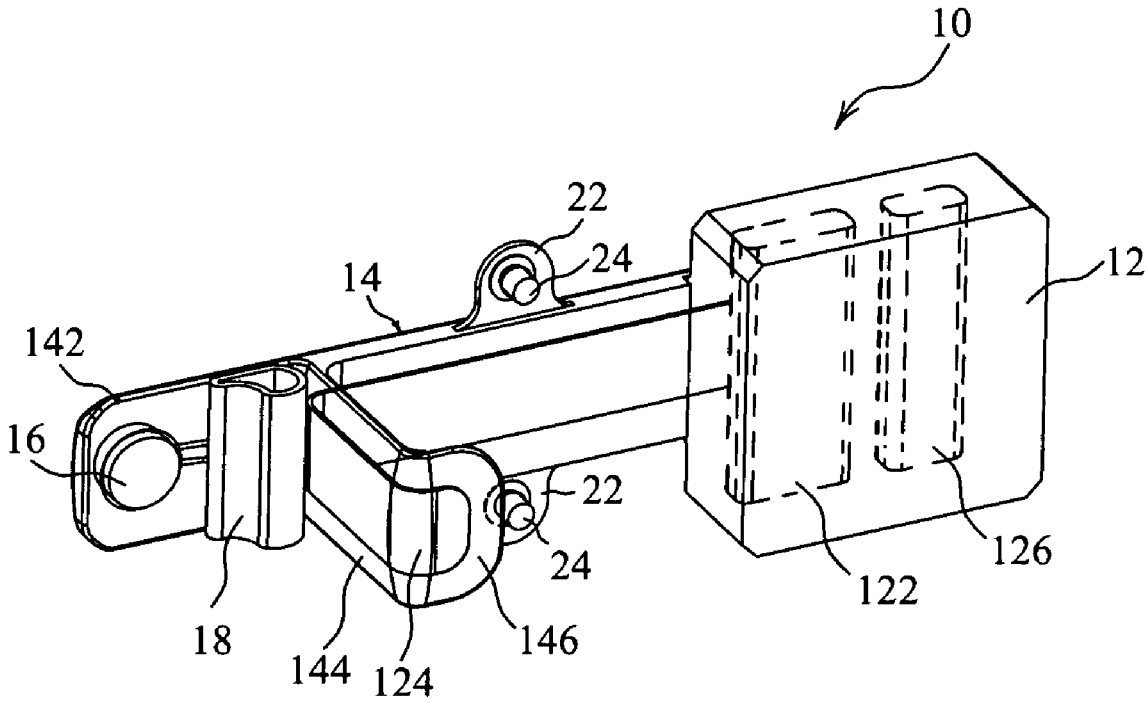
FIG. 5A is a schematic view illustrating a hidden security device with a couple of wing plates on the tightly-seized device thereof according to a third embodiment of the present invention.
Figure 5B:
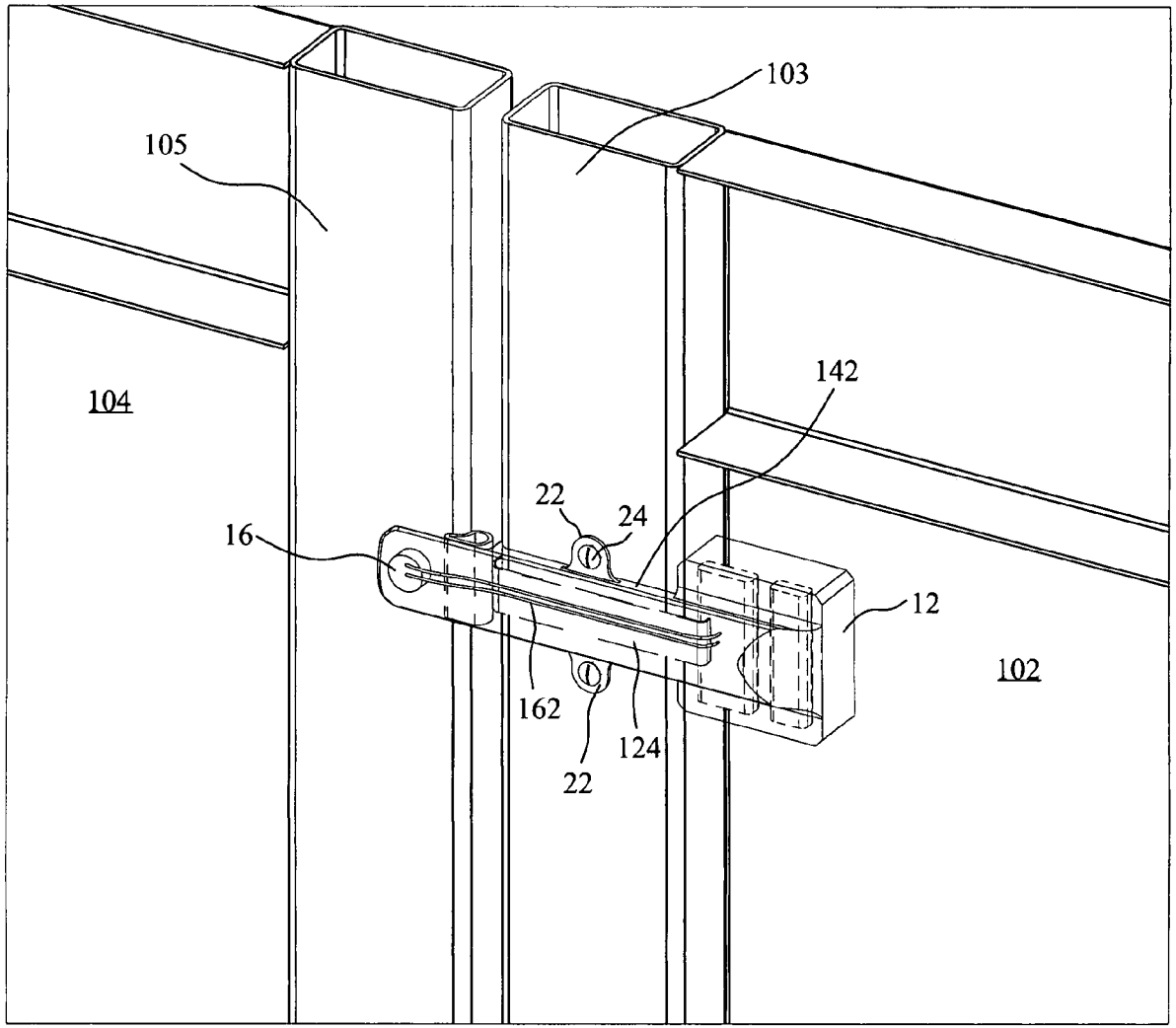
FIG. 5B is a schematic view illustrating the hidden security device of FIG. SA cooperating with the door plates.

Another preferred method of fixing is that, as shown in FIG. 5A, two wing plates 22 are extended from the plate 142 of the tightly-seized device 14 and fixed to the door plates 102 by bolts (or rivets) 24, as shown in FIG. 5B.

Figure 6:
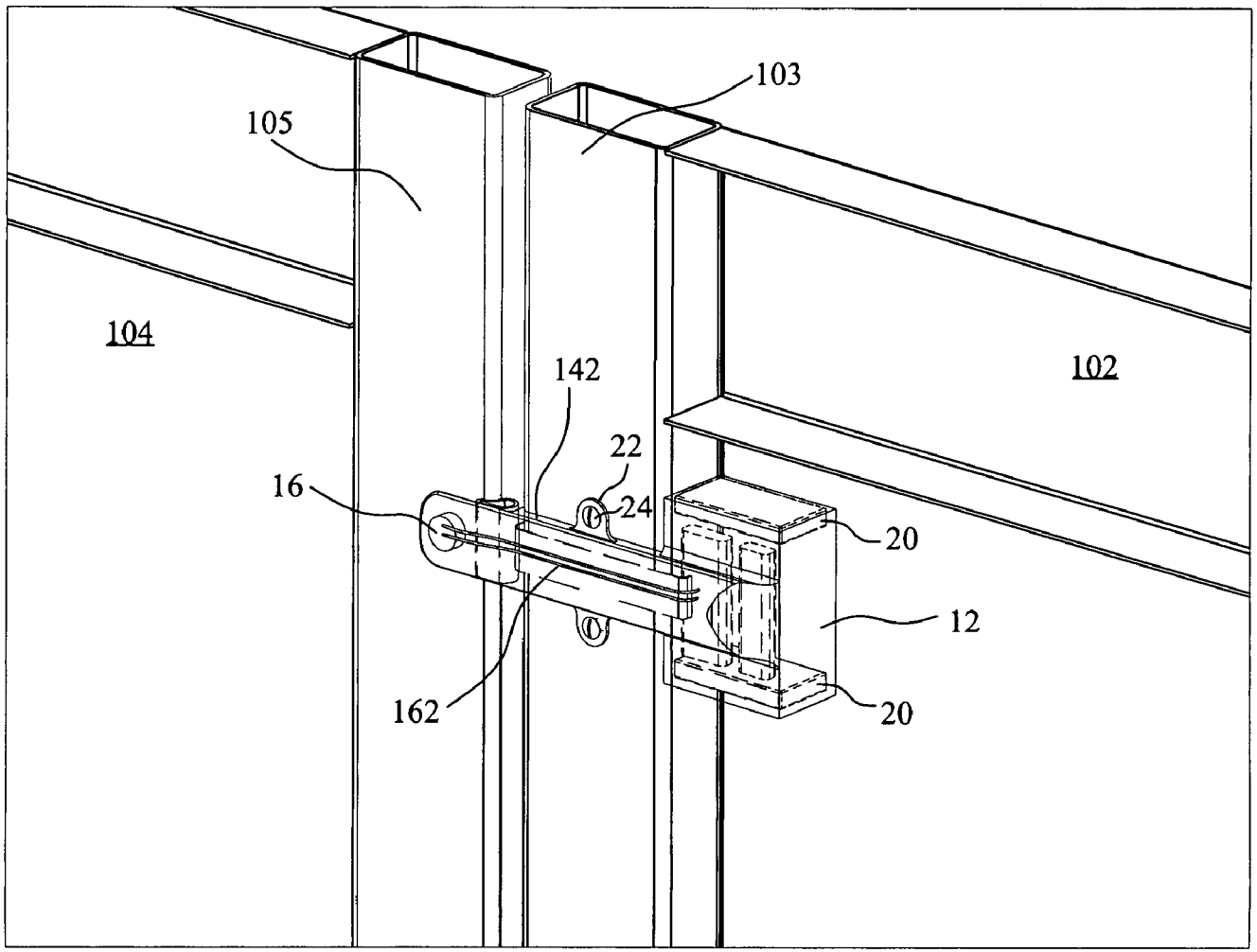
FIG. 6 is a schematic view illustrating a hidden security device according to a fourth embodiment of the present invention.

Certainly, the present invention can provide an embodiment with mixed methods of employing the attracting action of a magnet or by fixing the wing plates by bolts (or rivets), as shown in FIG. 6.

The present invention is described by illustrating examples with reference to the preferred embodiments, wherein a case 12 of the security device 10 is placed on the inner side of the left door plate 102, while the displacement sensor 16 is corresponding to the right door plate 104. It will be appreciated that according to the technical solution of the present invention, in the same way, the case 12 of the security device 10 can also be placed on the inner side of the right door plate 104, while the displacement sensor 16 is corresponding to the left door plate 102.

The descriptions herein refer to the preferred embodiments but are not limited to the embodied solution of the present invention. It will be apparent to those skilled in art that various modifications and variations can be made in the embodiments of the present invention according to the design and spirit hereof. Thus, it is intended that the embodiments of the invention covers the modifications and variations of this invention provided they come within the scope of the appended claims and their equivalents.

What is claimed is:

1. A hidden security device for container, comprising a case, provided with an electronic processing unit;

a tightly-seized device, including a plate, extending from said case, on which a displacement sensor communication with said electronic processing unit is mounted using pressure or friction fit at a predetermined place and a tightly-seized part, perpendicularly extending from said plate and having a flexing end; and an antenna, communicating with said electronic processing unit and extending out from said case to the flexing end of said tightly-seized part.

2. A security device according to claim 1, wherein said antenna is a thin elastic chip or is covered with an elastic chip.

3. A security device according to claim 2, wherein said tightly-seized device is of elastic material.

4. A security device according to claim 1, wherein said security device comprises a fixing device.

5. A security device according to claim 4, wherein said fixing device is a magnet provided in said case.

6. A security device according to claim 4, wherein said fixing device comprises a couple of wing plates extending from said plate and fixed by bolts or rivets.

7. A security device according to claim 1, wherein a vibration detector is placed in said case and communicates with said electronic processing unit for apperceiving vibrations at predetermined frequency.

8. A security device according to claim 1, wherein an anti-cheating blocker is placed on the outer side of said tightly-seized part for preventing the communication between said displacement sensor, antenna and said electronic processing unit from being cut down.

9. A container with a door structure of two door plates, comprising a hidden security device provided on the inner side of said door plates of container, including a case, corresponding to a first door plate and having an electronic processing unit therein;

a tightly-seized device, comprising a plate, extending from said case, on which a displacement sensor communication with said electronic processing unit is mounted using pressure or friction fit at a predetermined place corresponding to a second door plate; and a tightly-seized part perpendicularly extending out from said plate through a distance between the two door plates and having a flexing end; and an antenna, communicating with said electronic processing unit and extending out from said case to the flexing end of said tightly-seized part.

10. A container according to claim 9, wherein said tightly-seized part cooperates with a vertical doorpost of the first door plate to fix said security device, and said flexing end is disposed on the outer side of said door plates.

11. A container according to claim 10, wherein said antenna is a thin elastic chip or an antenna with an elastic chip.

12. A container according to claim 11, wherein said tightly-seized device is of elastic material.

13. A container according to claim 9, wherein said security device comprises a fixing device.

14. A container according to claim 13, wherein said fixing device is a magnet provided in said case.

15. A container according to claim 13, wherein said fixing device comprises a couple of wing plates extending from said plate and fixed to said door plate by bolts or rivets.

16. A container according to claim 9, wherein a vibration detector is placed in said case and communicates with said electronic processing unit for apperceiving vibrations at predetermined frequency.

17. A container according to claim 9, wherein an anti-cheating blocker is placed on the outer side of said tightly-seized part, corresponding to the distance between the first and second door plates, for preventing the communication between said displacement sensor, antenna and said electronic processing unit from being cut down.

* * * * *